US007073281B2

(12) United States Patent
Terashima

(10) Patent No.: US 7,073,281 B2
(45) Date of Patent: Jul. 11, 2006

(54) SPIKE FOR GOLF SHOES

(75) Inventor: Yasuyuki Terashima, Nagoya (JP)

(73) Assignee: Japana Co., Ltd., Aichi (JP)

( * ) Notice: Subject to any disclaimer, the term of this patent is extended or adjusted under 35 U.S.C. 154(b) by 48 days.

(21) Appl. No.: 10/482,432

(22) PCT Filed: Jun. 27, 2002

(86) PCT No.: PCT/JP02/06533

§ 371 (c)(1),
(2), (4) Date: Jun. 25, 2004

(87) PCT Pub. No.: WO03/001936

PCT Pub. Date: Jan. 9, 2003

(65) Prior Publication Data

US 2004/0237349 A1 Dec. 2, 2004

(30) Foreign Application Priority Data

Jun. 28, 2001 (JP) ..... 2001-196989

(51) Int. Cl.
*A43B 5/00* (2006.01)
*A43C 15/02* (2006.01)

(52) U.S. Cl. ..... 36/134; 36/127

(58) Field of Classification Search ..... 36/134, 36/127, 67 D; D2/962
See application file for complete search history.

(56) References Cited

U.S. PATENT DOCUMENTS

| | | | | | |
|---|---|---|---|---|---|
| 5,791,071 | A | * | 8/1998 | Rosdail | 36/134 |
| D416,127 | S | * | 11/1999 | Silvers | D2/962 |
| D432,770 | S | * | 10/2000 | Breault et al. | D2/962 |
| 6,167,641 | B1 | * | 1/2001 | McMullin | 36/127 |
| D448,546 | S | * | 10/2001 | Savoie | D2/962 |
| D449,431 | S | * | 10/2001 | Savoie | D2/962 |
| D449,921 | S | * | 11/2001 | McMullin | D2/962 |
| D450,915 | S | * | 11/2001 | McMullin | D2/962 |
| D455,896 | S | * | 4/2002 | Peabody | D2/962 |

FOREIGN PATENT DOCUMENTS

| | | |
|---|---|---|
| JP | H0(1990)-28607 | 2/1990 |
| JP | 2001-025401 | 1/2001 |
| JP | 2001-197907 | 7/2001 |

* cited by examiner

*Primary Examiner*—Ted Kavanaugh
(74) *Attorney, Agent, or Firm*—Adams Evans P.A.

(57) ABSTRACT

The present invention relates to spikes for golf shoes that ensure stability while walking and a sufficient gripping force for any green surface on a golf course, and that will never damage a delicate green surface such as a putting green. The spike for golf shoes is characterized by comprising a plurality of leg portions (2) extending downward from a spike main body (1), and a rounded bulge (B) formed on the front-end of each leg portion (2), wherein there will be no sharp portion produced in a bulge (B) even if the bulge (B) wears out.

8 Claims, 4 Drawing Sheets

SPIKE FOR GOLF SHOES

TECHNICAL FIELD

This is a national phase application of International Application PCT/JP02/06533, filed Jun. 27, 2002, and claims priority to Japanese Patent Application No. 2001-196989. filed Jun. 28, 2001. The present invention relates to spikes for golf shoes with superior durability and impact absorption. The present invention also relates to a method of manufacturing the golf spikes that ensures a sufficient gripping force for any green surface on a golf course without causing damage to the green surface (particularly, delicate puffing greens) or the floor surface in clubhouses. The spikes are also hardly worn out or damaged while walking on a hard asphalt surface or the like.

A spike according to this invention includes both spikes that are integrally formed on the bottom of a golf shoe and spikes that may be separately attached or detached from the bottom of a golf shoe using a screw or the like.

Particularly, the above spike can be suitably manufactured using a synthetic resin.

BACKGROUND ART

Conventionally, metal spikes of a needle-like shape are widely used as spikes for golf shoes. Owing to the metal spike, for example, even on a wet green slope, a strong gripping force is obtained.

However, since such metal spike ensures the gripping force by sticking into the green up to the soil layer thereof, the green surface after a wearer of the metal spike has walked thereon gets into a state where the green is slightly dug up. Particularly, on a putting green, this may cause some problems for the next play. Also, when a wearer of the conventional metal spike walks on a carpet in a clubhouse, it may cause damage to the carpet resulting in a problem.

Further, when a wearer of the metal spike walks on a hard ground such as a pavement, the wearer feels a stick-up feeling at the area of the spike. The wearer may also feel some instability while walking due to the small number of points supporting his/her weight. Thus, golf shoes equipped with the above-described metal spikes are also uncomfortable for the wearer. Still further, because the impact from the ground is transferred directly to the human body, there arises such problem that fatigue is accumulated on the feet, knees and waist bearing the impact.

In order to solve the above problems, spikes for golf shoes called "non-metal spikes" made from synthetic resin are now used. Owing to the resin spike, the wearer is free from stick-up feeling even on a hard road surface. Since there are many points that support the weight, stability is also obtained while walking.

As a resin spike as described above, there has been proposed a spike made from synthetic resin, which is disclosed in Japanese Unexamined Patent Application Publication No. H11-262401 corresponding to U.S. Patent Application No. 60/070735; and a spike made from synthetic resin disclosed in Japanese Patent Application No. 2000-14944 applied by the applicant of the present invention.

PROBLEM TO BE SOLVED BY THE INVENTION

With a conventional synthetic resin spike, compared to a metal spike, the impact to the human body is small, and the damage to the green surface and carpet is also relatively small. However, a plurality of legs is formed into a sharp shape (particularly, so as to become thinner from the base portion of a leg toward the front-end portion) so as to readily stick into the green surface. Accordingly, there still resides such problem that a short cut and a delicate green surface such as putting green may be damaged.

That is, in the conventional spike, almost all legs are formed in a shape that becomes thinner toward the front-end so as to readily stick into the green surface, or formed into a polyhedron-like shape having sharp edges. Therefore, careless walking causes damage on a short cut and delicate green surface.

Accordingly, an object of the present invention is to provide a spike, which ensures the stability while walking on a hard asphalt surface or floor surface in a clubhouse and sufficient gripping force for any green surface and will not damage a short cut and delicate green surface such as putting green.

Further, another object of the present invention is to provide a spike for golf shoes such that, even when the spike is worn away through walking on a hard asphalt surface or concrete surface, no sharp portion (edge) causing damage on the green or floor surface in a clubhouse is formed.

DESCRIPTION OF THE INVENTION

In order to solve the above object, a spike for golf shoes according to the present invention is characterized by comprising a plurality of leg portions 2 extending downward from a spike main body and having no sharp angular portion and bulges (protrusion) B formed on the front-end portion of said leg portions 2 (the spike set forth in claim 1).

In the spike constituted as described above, since the leg portions 2 has no sharp angular portion, damage to a delicate green surface such as putting green is minimized.

Also, in any embodiment of the invention, as for the direction of the bulges, the bulges B are preferably formed in the downward or sideward direction particularly, or in the downward and sideward directions with respect to the leg portions 2. By forming the bulges B of the leg portions 2 in the downward direction, the abrasion resistance and durability of the leg portions 2 is increased. By forming the bulges B of the leg portions 2 in the sideward direction with respect to the leg portions 2, since the clinging to the green surface is generated, the gripping force for the green surface is increased.

Since the bulges B are formed on the front-end portion of the leg portions 2, the bulges B cling to the green resulting in a strong gripping force with respect to the green surface.

The spike according to the present invention, when rounded bulges B are formed on the front-end portion of the leg portions, since there is no edge (sharp portion) on the bulges B, damage to the green is significantly reduced. Further, even when the bulges B are worn away, no sharp portion is formed on the bulges B.

The spike according to the present invention may comprise a plurality of flexible leg portions extending downward from the spike main body and bulges of spherical shape or oval sphere-like shape formed on the front-end portion of the flexible leg portions so as not to produce any sharp portion on the bulges even when the bulges are worn away.

Owing to the constitution as described above, first of all, on a green, the flexible leg portions 2 of the spike bite into the green due to the weight of the wearer of the golf shoes keeping almost original state and grip the green. On the other hand, on a hard ground such as pavement, since the flexible leg portions 2 are bent and provide an cushion effect, the load to the knees, waist or the like can be reduced resulting in a spike having a high degree of stability and that is easy to use.

Further, the spike according to the present invention, the main body of the spike may be provided with supporting projections 3, 7, of which projecting amount is slightly smaller than that of the plurality of the flexible leg portions so as to assist the flexible leg portions 2 in supporting the weight.

Owing to the constitution as described above, on a hard ground such as pavement, when the flexible leg portions 2 are bent, the supporting projections 3, 7, which have smaller downward projections, come into contact with the ground. Accordingly, the supporting projections 3 support the weight of the wearer of the golf shoes; thus, the flexible leg portions 2 are prevented effectively from being worn out rapidly.

As for the spike according to the present invention, projecting lines L or grooves (bumpy portion) R may be formed on the bottom face of the supporting projections 3, 7 so as to increase the friction force with respect to the ground or green surface. Here, projecting lines or grooves (bumpy portion) may have any shape if the "projections" or "grooves or dents" are for the purpose of increasing the friction force and provided on the contacting portions of the spike with the ground or green surface.

In the spike according to the present invention, the leg portions 2 are preferably extended downward and radially from a rim of main body 1 of the spike; thereby a large gripping force is obtained and the durability of the leg portions against the abrasion is increased.

In the spike according to the present invention, the main body 1 of the spike may have a detachable engaging portion 4 with respect to the rear face of the golf shoes (a spike set forth in claim 7). By adopting the above structure, the spike is detachably attached to the rear face of a golf shoe, and if necessary, the spike can be readily replaced.

In the spike according to the present invention constituted as described above, since the bulges B on the front-end portion of the leg portions 2 cling to the green providing anti-pull out effect, even when the spike is formed from a synthetic resin, a gripping force equivalent to that of a metal spike is obtained.

One of the reasons is that, particularly in the spike according to the present invention, since the bulges B always come into contact with ground first, the bulges B provide such effect that the body or base of the leg portions 2 is protected from being worn away.

Further, when the spike is worn away, since the shape of the bulges B is a rounded shape (preferably, spherical shape or oval sphere-like shape), no sharp portion is produced. Even when the spike is worn away, the spike according to the invention rarely damages the green surface.

EMBODIMENTS

Figure 1:
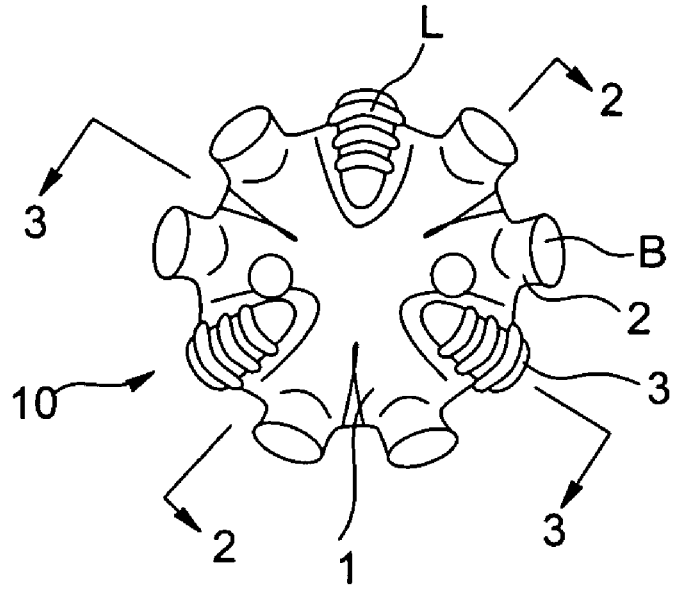
FIG. 1 is a bottom view of a spike for golf shoes according to a first embodiment of the present invention.

Hereinafter, referring to FIG. 1 through FIG. 5, the best mode for carrying out the present invention (embodiment 1) will be described.

A spike 10 according to the present invention comprises the main body 1 of the spike constituting a base portion of a roughly disk-like shape (frustum-like shape), six flexible leg portions 2 radially extending downward from the rim of the rear face of the main body 1 at predetermined intervals and three supporting projections 3, which are disposed between the flexible leg portions 2, and the amount of the downward projection is slightly smaller than that of the flexible leg portions 2.

That is, in the spike 10 according to this embodiment, as the flexible leg portions 2, three pairs of flexible leg portions 2, in which two flexible leg portions separated away from each other by approximately 40° form a pair, are disposed at the same intervals, and disposed between the flexible leg portions 2 separated away from each other by approximately 80° are supporting projections 3.

The flexible leg portions 2 are extending downward from the spike main body 1, and the body thereof is formed in a roughly cylindrical shape respectively so as not to have such sharp edge, which can damage the green.

Further, the flexible leg portions 2 are formed in a girth respectively so as to have such strength that, on a hard ground such as a pavement covered with asphalt, the leg portions are slightly bent due to the weight of the wearer of the golf shoes, and are formed radially downward from the base portion of the above-described main body 1.

Here, the wording "radially downward" generally means, "to be formed so as to extend downwardly from the rear face of the spike main body and spread slightly outward from the rim (or central portion) of the spike main body". Owing to the above structure, the flexible leg portions 2 slightly deform so as to further expand outward due to the weight of the wearer of the golf shoes.

Figure 5:
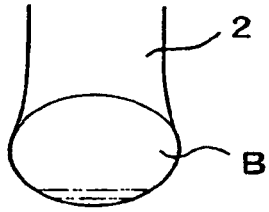
FIG. 5 is an enlarged view of a bulge of the spike shown in FIG. 1, which shows a worn state thereof indicated with a virtual line.

Further, at the front-end portion of the flexible leg portions 2, a rounded bulges B having an oval sphere-like shape is formed. As shown in FIG. 5, even when the bulges B are worn away, no sharp portion is formed in the bulges B. The bulges B according to the embodiment is formed so as to bulge mainly downward with respect to the spike and sideward (toward the neighboring other legs).

Figure 6:
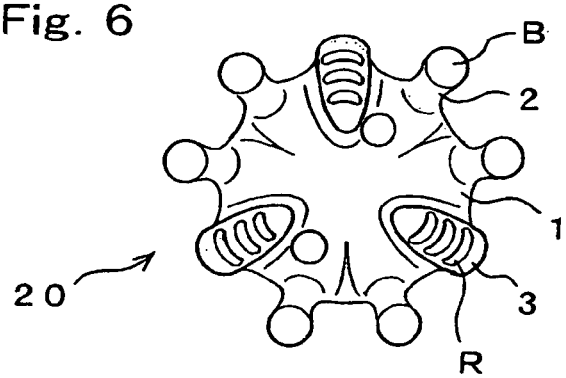
FIG. 6 is a bottom view of a modification of the spike according to the present invention.
Figure 7:
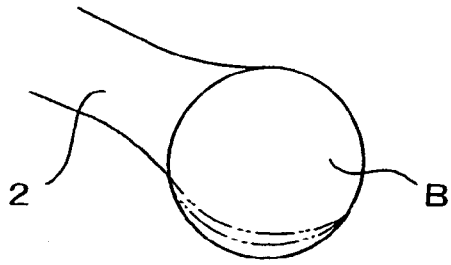
FIG. 7 is an enlarged view of a bulge of the spike shown in FIG. 6, which shows a worn state thereof indicated with a virtual line.

In order to prevent any sharp portion from being formed in the bulges B even when the bulges B is worn away, the shape of the bulges B may be formed into a rounded spherical shape like a spike 20 shown in FIG. 6 and FIG. 7.

When used on a green surface, the flexible leg portions 2 structured as described above are hardly bent, and front-end portions of the leg portions 2 bite into the green surface by catching the grass on the green surface between the front-end portions of the leg portions 2, and the bulges B of the front-end portions provide a strong gripping force with respect to the green surface. It is understandable that, when the green caught between the bodies of plural leg portions 2 slips out, since it is necessary for the green to pass through the narrower space between the bulges B, the gripping force is increased.

On the other hand, since the above-described flexible leg portions 2 are bent, the supporting projections 3 come into contact with the ground and support the weigh of the wearer of the golf shoes. That is, on a green or carpet, the supporting projections 3 come into contact with the green surface and the like and provide a gripping force. On the other hand, on a hard ground such as asphalt pavement, the supporting projections 3 mainly support the weight of the wearer of the golf shoes and prevent the flexible leg portions 2 from being rapidly worn out (too-large worn out) due to an undesirable bend of the leg portions 2. Accordingly, as for the supporting projections 3, if the above-described effects are obtained, any shape thereof may be adopted. To be more precise, it is preferred that, between the above-described flexible leg portions 2, the supporting projections 3 are formed so that the projecting amount thereof is smaller than that of the flexible leg portions 2 and the girth of the supporting projections 3 is slightly larger than that of the flexible leg portions 2; thereby the weight of the wearer of the golf shoes is reliably supported.

Figure 8:
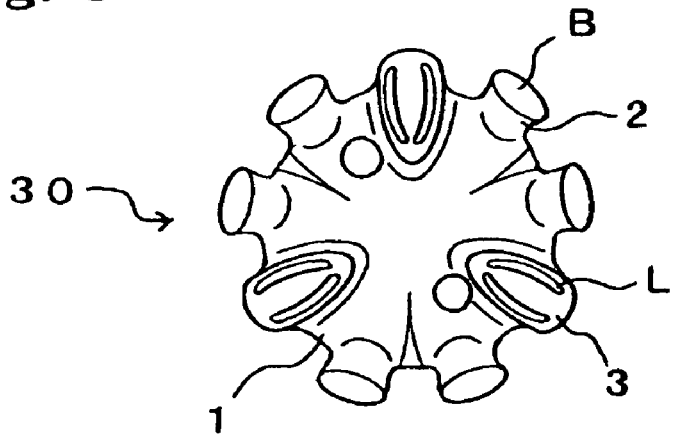
FIG. 8 is a bottom view of another modification of the spike according to the present invention.
Figure 9:
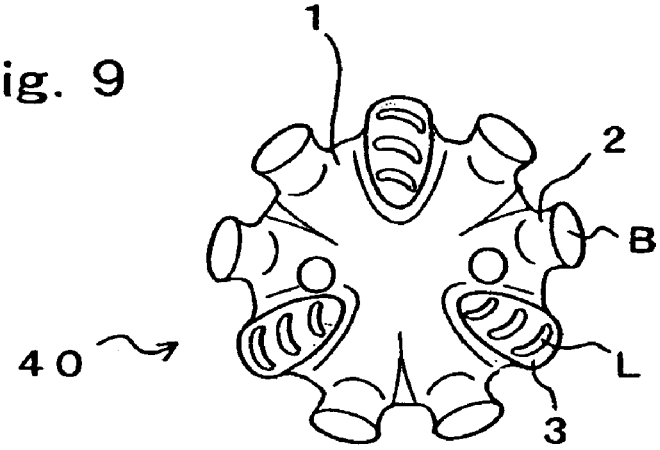
FIG. 9 is a bottom view of still another modification of the spike according to the present invention.
Figure 10:
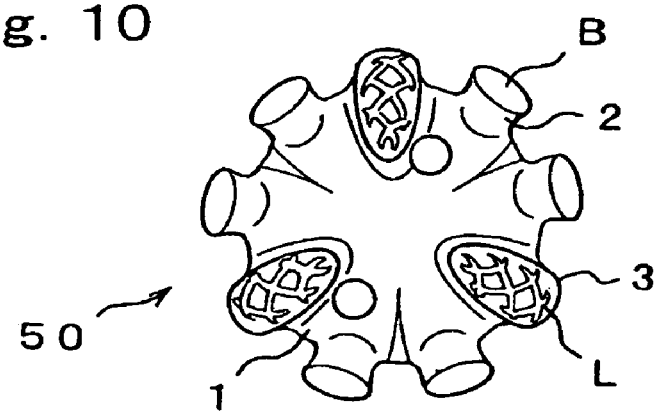
FIG. 10 is a bottom view of still another modification of the spike according to the present invention.

The above-described supporting projections 3 according to the embodiment have a plurality of projecting lines L to increase the friction force with respect to the ground or green surface. As for the projecting lines L, it is conceivable that the lines are formed in the direction of concentric circle with respect to the center of the spike 10 as shown in FIG. 1; the lines are formed radially from the center of a spike 30 as shown in FIG. 8; the lines are formed in the angled direction (whorled shape) shown in a spike 40 in FIG. 9; or the lines are formed in a grid-like shape as shown in a spike 50 in FIG. 10.

Further, in place of these projecting lines L, as shown in the spike 20 in FIG. 6, a plurality of grooves (bumpy portion) R may be formed on the bottom face of the supporting projections 3.

Since the number, the direction and the shape of the projecting lines L or grooves (bumpy portion) R formed on the supporting projections 3 affect on the friction force of the spike with respect to the ground, they may be changed appropriately according to the performance and characteristics required for the spike.

For example, when the projecting lines L or grooves (bumpy portion) R are formed in the direction of concentric circle with respect to the center of the spike, the friction force of the linear direction such as front-rear, right-left or angled direction with respect to the spike can be increased. When the projecting lines L or grooves (bumpy portion) R are formed radially from the center of the spike, the friction force in the rotational direction around the center of the spike can be increased.

As for the material for the main body 1 of the spike and supporting projections 3, in addition to synthetic resins of polyurethane, synthetic rubber, ABS, polycarbonate and nylon, any materials such as metal, ceramics or composite material of these materials may be used.

As for the material for the above described flexible leg portions 2, in addition to synthetic resins of polyurethane, synthetic rubber, ABS, polycarbonate and nylon, any materials, which bend due to the weight of a user, such as flexible metal or composite materials of flexible metal and synthetic resin, may be used.

When the spike is formed using a synthetic resin, in the case where the spike is integrally formed by using compounded synthetic resins having different hardness respectively, it is conceivable that, for example, in the flexible leg portions 2, a material of low hardness is used to ensure satisfactory flexibility; on the other hand, the supporting projections 3 is formed by using a material of high hardness to enhance the abrasion resistance; thereby the entire durability of the resin spike is increased.

The main body 1 of the spike serves as a base for mounting the flexible leg portions 2 and the supporting projections 3 as well as for mounting the spike to the rear face (sole) S of a golf shoe. When the above is attainable, any shape is acceptable. To be more precise, a disk-like shape, which is equipped with an engaging portion 4 for mounting the spike to the rear face S of the golf shoe on the upper end face thereof, may be adopted.

Figure 2:
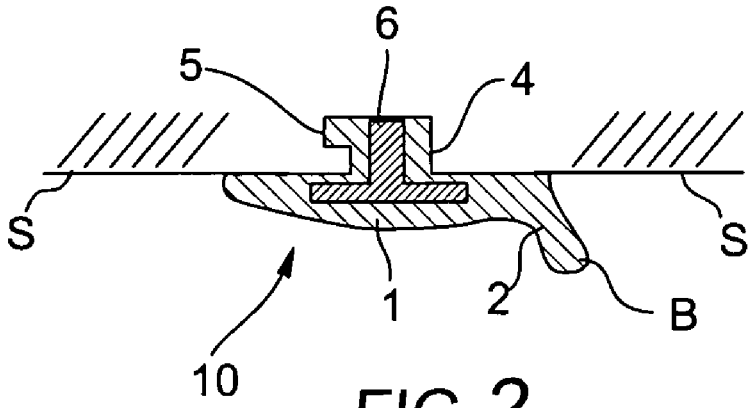
FIG. 2 is a sectional view of the spike shown in FIG. 1 taken along the line X—X in FIG. 1.
Figure 3:
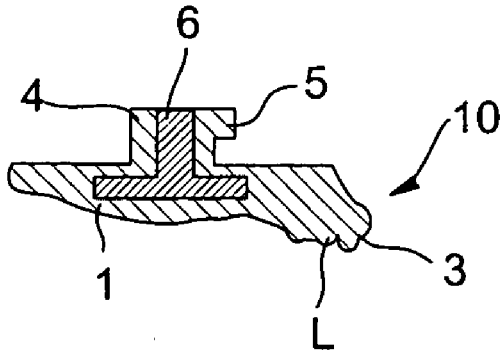
FIG. 3 is a sectional view of the spike shown in FIG. 1 taken along the line Y—Y in FIG. 1.
Figure 4:
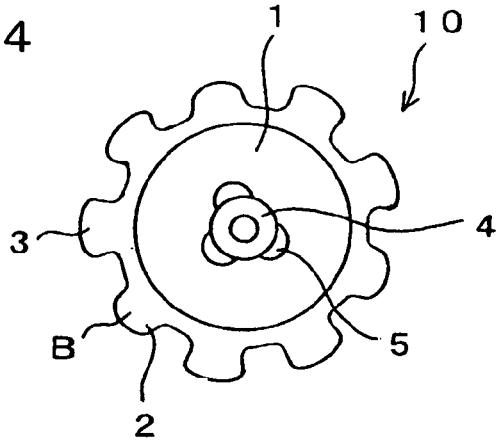
FIG. 4 is a plan view of the spike shown in FIG. 1.

Here, as shown in FIG. 2 through FIG. 4, the engaging portion 4 for mounting the spike to the golf shoe is equipped with an engaging projection portion 5 having a predetermined shape for locking the spike engaged with an engagement hole formed on the rear face S of the golf shoe. It is preferred that, in the center of the engaging portion 4, a metal reinforcement pin 6 is embedded to increase the strength of the engaging portion 4 itself.

Each of the above spikes 10, 20, 30, 40 and 50 according to the present invention is entirely formed using dies; that is, the main body 1 of the spike, the flexible leg portions 2, the supporting projections 3, the engaging portion 4 and the engaging projection portion 5 are formed integrally by injection molding. However, since the bulges B are formed at the front-end portion of the flexible leg portions 2, it is difficult to form a whole shape through drawing out the plurality of legs from a single die. Accordingly, ordinarily a split die is used.

The spike 10, 20, 30, 40, 50 according to the embodiment, which is made from synthetic resin and structured as described above, owing to the bulges B formed on the plurality of flexible leg portions 2, gives little damage to the green surface or floor surface but has a high durability against the abrasion. Further, the bulges B formed on the front-end portion of the leg portions 2 catch the green providing a function as the gripping portion of the leg portions 2. Accordingly, a superior gripping force with respect to the green can be obtained.

Furthermore, in the synthetic resin spike 10, 20, 30, 40, 50 according to the embodiment, the plurality of flexible leg portions 2 are formed from synthetic resin. When walking on a hard road surface such as asphalt surface or floor surface, since the leg portions 2 are bent and deflected, the impact from the ground is absorbed and reduces the load on the knees, waist and the like. Accordingly, a spike having a high impact absorption performance and stability, which is easy to use, can be provided.

Spikes in each of the above-described embodiments are equipped with the engaging projections 5 on the engaging portion 4 with rear face S of the golf shoe separated 120° away from each other. By manipulating two concave portions formed on the bottom face of the spike main body 1, which are 180° away from each other, using a dedicated handle, the spike 10 can be readily attached or detached from the engagement hole formed on the rear face of the golf shoe.

Next, referring to FIG. 11 and FIG. 12, a second embodiment (embodiment 2) of the spike according to the present invention will be described.

Figure 11:
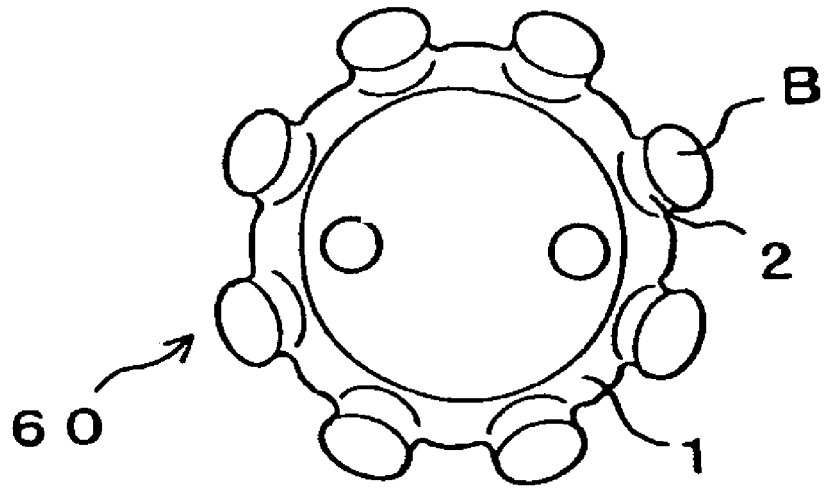
FIG. 11 is a bottom view of the spike for golf shoes according to a second embodiment of the present invention.
Figure 12:
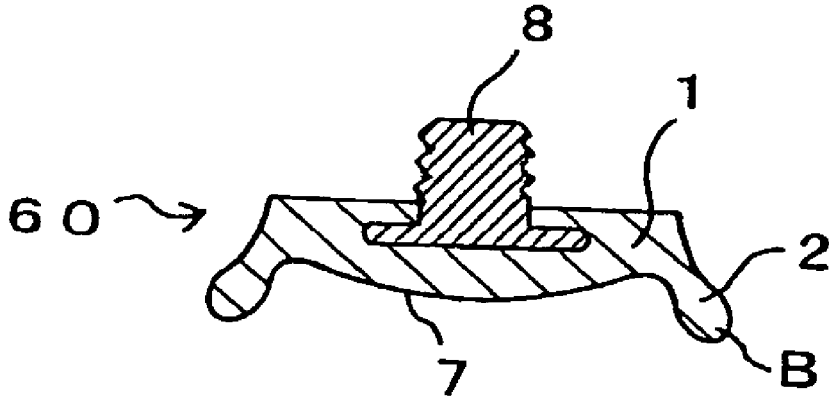
FIG. 12 is a sectional view of the spike shown in FIG. 11.

As shown in FIG. 11 and FIG. 12, a spike 60 according to the embodiment has a main body 1 and eight flexible leg portions 2 extending from the periphery of the rear face of the main body 1 downward and radially at predetermined intervals. That is, in the spike 60 according to the embodiment, as the flexible leg portions 2 thereof, the flexible leg portions 2 are disposed approximately 40° away from each other at the same intervals.

The flexible leg portions 2 are formed downward, and same as the above-described embodiment, radially from the base portion of the main body 1 into a girth which provides a strength such that the flexible leg portions 2 are slightly bent due to the weight of a wearer of the golf shoes on a hard ground such as an asphalt pavement.

When used on a green surface, the flexible leg portions 2 structured as described above are bent little, and the front-end portions of the leg portions 2 bite into the green surface so as to cling to the same providing a strong gripping force.

Further, same as the above described embodiment, on the front-end portion of the flexible leg portions 2, a bulge B having a rounded oval sphere-like shape are formed respectively. As shown in FIG. 11 and FIG. 12, it is arranged so that, even when the bulges B are worn away, no sharp portion is produced on the bulges B.

Further, the spike 60 according to the embodiment is provided with the flexible leg portions 2 and a supporting projection 7 having a thick central portion in the rear face of the main body 1. Accordingly, owing to the supporting projection 7, the weight of the wearer of the golf shoes can be supported, and since the stability during use is further increased, the supporting projection 7 is effective. It is understood that the supporting projection 7 is preferably formed in an approximately same dimension (projecting amount) as the flexible leg portions 2 in a state where the flexible leg portions 2 are bent due to the weight of the wearer of the golf shoes, but this is not limited thereto.

By adapting the projecting amount of the supporting projection 7 in the central portion to a level approximately the same as the projecting amount of the bent flexible leg portions 2, it is possible to prevent the flexible leg portions 2 from being worn away drastically due to the contact between the supporting projection 7 and the ground. Thus, it is possible to prevent the gripping forth from decreasing drastically due to the abrasion in each of the leg portions 2 of the spike 60.

On the upper end of the main body 1, a male screw 8 for mounting the spike to a golf shoe is provided being protruding therefrom. The male screw 8 is screwed into a female screw provided on the rear face of the golf shoe. As for the male screw 8, a male screw for screwing into a golf shoe may be embedded and fixed, or a resin screw formed with a thread surface thereon may be adopted.

In the spike 60 according to the embodiment, the above-described portion can be integrally formed using a synthetic resin. The entire spike may be formed using a hard material such as a metal or ceramics. However, in this case, the flexibility of the leg portions 2 is greatly reduced or eliminated.

The present invention is not limited to the above-described embodiments. Such spike that the rear face S of a golf shoe and a spike main body 1 are integrally formed so as not to allow the spike main body 1 to be replaced is also within the scope of the present invention.

As for the above-described flexible leg portions 2, in addition to the case where the flexible leg portions 2 are disposed at the equal intervals, by appropriately selecting the intervals from approximately 30° through 120°, the flexible leg portions 2 may be disposed at the unequal intervals. Also, the supporting projections 3 may be disposed between every gap of flexible leg portions 2, or the disposing position of the supporting projections 3 may be appropriately altered depending on the number of flexible leg portions 2 or the disposing intervals thereof.

Accordingly, the number of the flexible leg portions 2 may be selected from 2, 3, 4, 5, 6, 7, 8 and the like; the number of the supporting projections 3 also may be selected from 2, 3, 4, 5, 6, 7, 8 and the like.

These numbers may be appropriately altered depending on the strength of the material such as synthetic resin or metal, the girth and length of the leg portions or the like. By altering the numbers while taking those elements into consideration, the gripping force of the spike, the direction of the gripping force, the durability, wearing feeling and the like can be appropriately altered.

Further, in a case that all of the leg portions 2 do not have the flexibility just like the case where the entire spike is formed using a hard material such as metal or ceramics, the invention may be implemented though providing the supporting projections 3 or the supporting projection 7.

The bulges B of oval sphere-like shape may be carried out by changing the orientation of the bulges B from laterally long shape to vertically-long shape, or, by forming the shape thereof thinner or thicker. Also, the bulges B may be carried out by adopting a spherical shape for the bulges B; or, by mixing the bulges B of spherical shape and oval sphere-like shape with each other.

As for the shape of the bulges B, (1) in the case where the front-end portion of the leg portions is formed thicker particularly in the side direction, since clinging effect to the green surface is generated, the gripping force with respect to the green surface is increased; (2) in the case where the front-end portion of the leg portions is formed to be thicker in the downward direction, the abrasion resistance and durability of the leg portions is increased; (3) in the case of rounded shape, the green surface can be prevented from being damaged as much as possible. The actual shape may be appropriately selected while taking those characteristics into consideration, and is not limited to a specific shape.

As for the bulges B, when the front-end portion of the leg portions is bulged into a spherical shape or oval sphere-like shape at least in the either downward or sideward direction, sharp portion due to abrasion can be prevented from being produced, and the gripping force with respect to the green can be enhanced. The bulges B of the leg portions bulged both in the downward and sideward directions, a predetermined effect can be obtained. Further, the bulges B may be carried out by being bulged into a spherical shape or oval sphere-like shape in the downward and sideward, as well as upward directions.

Further, in the case where the shape of the bulges B is formed into a rounded shape, even when the body of the leg portions has an angular portion of a polyhedron to a certain extent, the green surface can be effectively prevented from being damaged. Such embodiment is also included in the scope of the present invention.

EFFECTS OF THE INVENTION

In the spike according to the present invention comprised of a plurality of leg portions extending downward from the main body of the spike, which has no sharp angular portion, since the leg portion 2 has no sharp angular portion, a superior effect such that the spike rarely damages delicate green surface such as putting green is obtained.

In the spike according to the present invention, owing to the bulges formed on the plurality of legs, in particular, by forming the bulges into a rounded shape, the green surface or floor surface rarely gets damaged especially. Thus, a unique effect such that the spike is superior in durability against the abrasion is obtained. That is, in the spike according to the present invention, since the bulges B always come into contact with the ground first, the bulges prevent the body portion or the base portion of the leg portions from being worn out.

Furthermore, in the spike according to the present invention, since the bulges formed on front-end portion of the legs cling to the green and provide an anti-pull out effect of the leg portions, the spike having superior gripping force with respect to the green can be obtained.

Accordingly, in the spike according to the present invention, by forming the bulges into a rounded shape initially, the bulges manage to remain rounded even as they are worn away after continuous use. Thus the resulting spikes have superior durability and gripping force and damage to the green surface or floor surface is minimized or avoided.

Further, when the entire spike is formed from a synthetic resin, the spike provides such superior and unique effect that, when walking on a hard road surface such as asphalt surface or floor surface the impact from the ground is absorbed and the load to knees, waist and the like is reduced because the plurality of leg portions are bent and deflected. The spike according to the invention also has a high degree of stability and is extremely easy to use.

The invention claimed is:

1. A golf shoe spike, comprising:

(a) a base having a plurality of radially-outwardly extending annular legs, each of the legs having a shape defining a generally diametrical cross-section devoid of sharp edges and angles;

(b) each of the legs having a respective rounded bulge on a tree end thereof, each bulge having a diameter greater than a diameter of the respective leg intermediate the base and the bulge, whereby the bulges increase the gripping force of the spike on a ground surface while reducing damage to the ground surface by increasing the surface area of the ground surface engaged by the legs of the spike.

2. A golf shoe spike, comprising:

(a) a base having a plurality of radially-outwardly extending annular legs, each of the legs having a shape defining a generally diametrical cross-section devoid of sharp edges and angles;

(b) each of the legs having a respective rounded bulge on a free end thereof, each bulge having a diameter greater than a diameter of the respective leg intermediate the base and the bulge, whereby the bulges increase the gripping force of the spike on a ground surface while reducing damage to the ground surface by increasing the surface area of the ground surface engaged by the legs of the spike; and (c) the rounded bulges are adapted to wear away without producing sharp edges and angles.

3. A golf shoe spike according to claim 1 or 2, wherein the bulges define a generally spheroid-like shape.

4. A golf shoe spike according to claim 3, wherein the base of the spike includes support projections alternately positioned intermediate respective adjacent bulges, the support projections extending outwardly from the base by a distance less than the height of the legs above the base for assisting the legs in supporting a body weight of a person wearing shoes having the spikes affixed thereto.

5. A golf shoe spike according to claim 4, wherein the support projections include raised areas on an exposed surface thereof for increasing frictional engagement with a ground surface.

6. A golf shoe spike according to claim 2, wherein the legs extend downwardly and radially outwardly from a rim of the base of the spike.

7. A golf shoe spike according to claim 6, wherein the base includes an engaging portion for detachably attaching the spike to the sole of a golf shoe.

8. A golf shoe spike according to claim 7, wherein the base is formed from a synthetic resin that wears due to contact with hard ground.

* * * * *